US006060427A

United States Patent [19]

Mori et al.

[11] Patent Number: 6,060,427

[45] Date of Patent: May 9, 2000

[54] THERMOSENSITIVE RECORDING MATERIAL

[75] Inventors: Yasutomo Mori, Numazu; Mitsuru Naruse, Mishima; Takeshi Akimoto, Numazu, all of Japan

[73] Assignee: Ricoh Company, Ltd., Tokyo, Japan

[21] Appl. No.: 09/134,452

[22] Filed: Aug. 14, 1998

[30] Foreign Application Priority Data

Aug. 15, 1997 [JP] Japan ..... 9-233273
Aug. 12, 1998 [JP] Japan ..... 10-239460

[51] Int. Cl.[7] ..... B41M 5/40

[52] U.S. Cl. ..... 503/200; 427/152; 503/226

[58] Field of Search ..... 427/152; 503/200, 503/226

[56] References Cited

U.S. PATENT DOCUMENTS

| | | | |
|---|---|---|---|
| 4,742,041 | 5/1988 | Kensuke et al. | 503/200 |
| 5,409,881 | 4/1995 | Mori et al. | 503/207 |
| 5,427,996 | 6/1995 | Motoda et al. | 503/200 |
| 5,536,697 | 7/1996 | Hada et al. | 503/207 |
| 5,622,909 | 4/1997 | Furuya et al. | 503/216 |
| 5,646,088 | 7/1997 | Hada et al. | 503/209 |
| 5,703,006 | 12/1997 | Mori et al. | 503/207 |
| 5,721,190 | 2/1998 | Miyamoto et al. | 503/207 |

FOREIGN PATENT DOCUMENTS

| | | |
|---|---|---|
| 0436390 | 7/1991 | European Pat. Off. . |
| 0437609 | 7/1991 | European Pat. Off. . |

OTHER PUBLICATIONS

Patent Abstracts of Japan, vol. 010, No. 193 (M–496), Jul. 8, 1986 (abstract of JP 61 037467A).

Database WPI, Sec. Ch, Week 8607, Derwent, Class A89, AN 86–045676, XP002099094 (abstract of JP 60–264284A).

*Primary Examiner*—Bruce H. Hess
*Attorney, Agent, or Firm*—Cooper & Dunham LLP

[57] ABSTRACT

A thermosensitive recording material including a substrate, a thermosensitive coloring layer which is formed overlying the substrate and which induces color formation upon application of heat, and a protective layer which is formed overlying the thermosensitive coloring layer and which includes a resin, wherein the protective layer is formed by coating with a liquid including a core-shell type emulsion of the resin, and wherein the core-shell type emulsion of the resin is prepared by polymerizing monomers including (d) acrylamide and/or methacrylamide and (e) a vinyl monomer having a hydroxy group in the presence of a seed emulsion which is prepared by polymerizing monomers including (a) acrylamide and/or methacrylamide, (b) acrylonitrile and (c) a vinyl monomer having a hydroxy group.

13 Claims, 1 Drawing Sheet

THERMOSENSITIVE RECORDING MATERIAL

BACKGROUND OF THE INVENTION

1. Field of the Invention

The present invention relates to a thermosensitive recording material, and more particularly to a thermosensitive recording material having a substrate and a thermosensitive coloring layer which is formed on the substrate and which can induce color formation upon application of heat.

2. Discussion of the Related Art

A thermosensitive recording material having a substrate such as paper or a film and a thermosensitive coloring layer which is formed on the substrate and which includes a color forming composition is well known. Colored images can be formed on the recording material upon application of heat with a thermal printhead, a heat pen or the like. The thermosensitive recording material is used as recording sheets for various recording apparatus. The thermosensitive recording material generally has a drawback in that recorded images are erased, or non-image areas are colored when the recording material contacts water, oils or various chemicals. In attempting to solve this problem, it is proposed to form a protective layer on the thermosensitive coloring layer.

For example, Japanese Laid-Open Patent Publications Nos. 54-128347, 54-3594, 56-126193 and 56-13993 have disclosed thermosensitive recording materials including a protective layer including a water-soluble resin. In addition, Japanese Laid-Open Patent Publications Nos. 57-188392, 64-61287 and 60-68990 have disclosed thermosensitive recording materials including a protective layer including a water-soluble resin together with a water-resistant applying agent. However, these recording materials cannot entirely improve the resistance to chemicals and have a drawback of poor ability to be used with thermal printheads. Further, Japanese Laid-Open Patent Publications Nos. 5-69665, 6-239019 and 5-318926 have disclosed thermosensitive recording materials including a protective layer which is formed by coating with a liquid including a core-shell type resin emulsion (the core-shell type resin emulsion means a resin emulsion in which particles of the resin which have two or more layers are emulsified). However, these recording materials cannot entirely improve the resistance to chemicals and the ability to be used with thermal printheads, and further have a drawback in that the protective layers thereof have much worse resistance to cracking than the protective layers including a water-soluble resin mentioned above.

Because of these reasons, a need exists for a thermosensitive recording material having good resistance to water and chemicals, good ability to be used with thermal printheads and good color forming properties without occurrence of cracking of the protective layer.

SUMMARY OF THE INVENTION

Accordingly, an object of the present invention is to provide a thermosensitive recording material having good resistance to water and chemicals, good ability to be used with thermal printheads and good color forming properties without occurrence of cracking of the protective layer.

To achieve such an object, the present invention contemplates the provision of a thermosensitive recording material which includes a substrate, a thermosensitive coloring layer which is formed on the substrate and which can induce color formation upon application of heat, and a protective layer which is formed on the thermosensitive coloring layer and which includes a resin, wherein the protective layer is formed by coating with a liquid including a core-shell type emulsion of the resin, and wherein the core-shell type emulsion of the resin is prepared by polymerizing monomers including (d) acrylamide and/or methacrylamide and (e) a vinyl monomer having a hydroxy group in the presence of a seed emulsion which is prepared by polymerizing monomers including (a) acrylamide and/or methacrylamide, (b) acrylonitrile and (c) a vinyl monomer having a hydroxy group.

When the seed emulsion is prepared, an acetoacetyl modified polyvinyl alcohol and/or a highly crystallized polyvinyl alcohol are preferably used as a protective colloid.

In addition, the protective layer preferably includes a compound having two or more alkyleneimino groups.

Further, the thermosensitive recording material preferably includes a back-coat layer which includes the resin which is described above for use in the protective layer.

These and other objects, features and advantages of the present invention will become apparent upon consideration of the following description of the preferred embodiments of the present invention taken in conjunction with the accompanying drawing.

DESCRIPTION OF THE PREFERRED EMBODIMENTS

Figure 1:
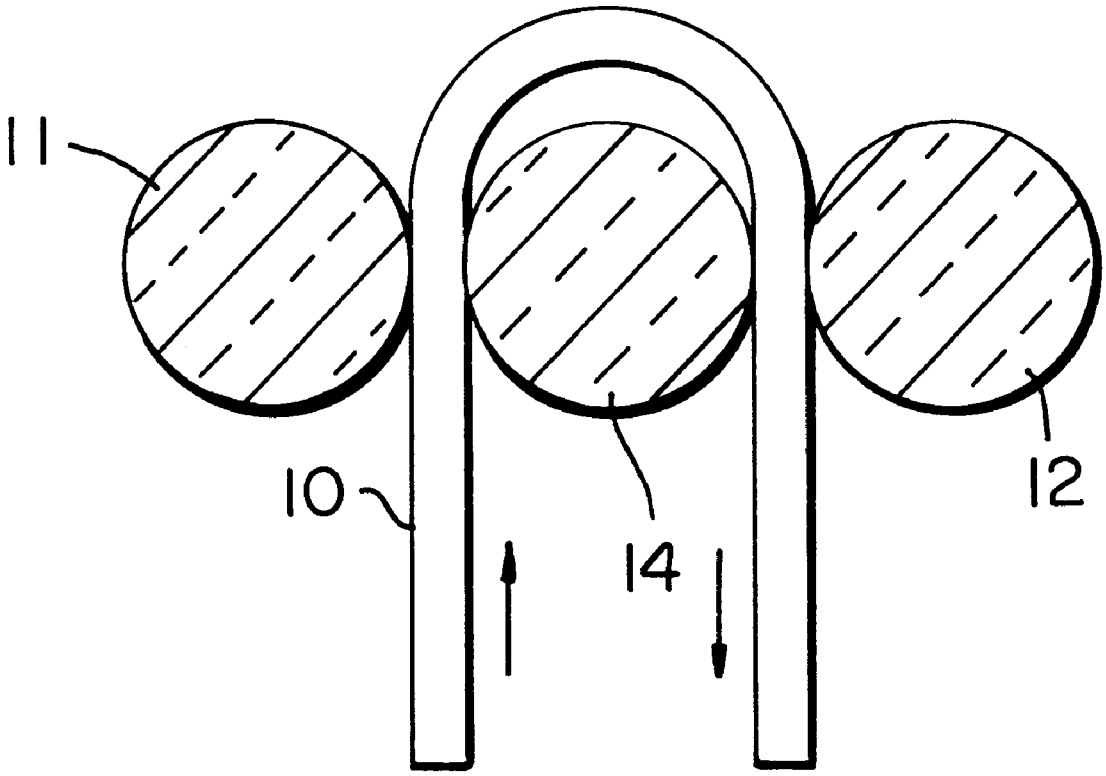
FIG. 1 is a schematic diagram illustrating a sectional view of an apparatus useful for evaluating cracking resistance of a thermosensitive recording material in the present invention.

Generally, the present invention provides a thermosensitive recording material (hereinafter recording material) which includes a substrate, a thermosensitive coloring layer (hereinafter coloring layer) which is formed on the substrate and which can induce color formation upon application of heat, and a protective layer which is formed on the coloring layer and which includes a resin, wherein the protective layer is formed by coating with a liquid including a core-shell type emulsion of the resin, and wherein the core-shell type emulsion of the resin is prepared by polymerizing monomers including (d) acrylamide and/or methacrylamide and (e) a vinyl monomer having a hydroxy group in the presence of a seed emulsion which is prepared by polymerizing monomers including (a) acrylamide and/or methacrylamide, (b) acrylonitrile and (c) a vinyl monomer having a hydroxy group.

When the seed emulsion is polymerized, acetoacetyl modified polyvinyl alcohol and/or highly crystallized polyvinyl alcohol is preferably used as a protective colloid. The protective colloid is preferably present in the core-shell type emulsion in an amount of about 20% or more by weight on a dry basis.

The protective layer of the recording material of the present invention may further include one or more known resins which have been used in the protective layer of conventional recording material. Specific examples of such resins include natural resins such as sodium alginate, starch, casein, cellulose derivatives and the like; and synthetic resins. Among these resins, polyvinyl alcohol, polymers having a plurality of carboxylic groups, polyacrylamide, and modified resins and derivatives of these resins are preferable because of having good film forming ability and ability to react with an alkyleneimino group which is included in a compound having a plurality of alkyleneimino groups which serves as a crosslinking agent and which is described later. Suitable modified resins and derivatives of these resins for use in the protective layer include copolymers which are obtained by copolymerizing or graft-copolymerizing one or more other components with polyvinyl alcohol, a polymer having a plurality of carboxyl groups, or polyacrylamide, or by pendently combining one or more other components with the functional groups of polyvinyl alcohol, a polymer having a plurality of carboxyl groups, or polyacrylamide.

Among polyvinyl alcohol (hereinafter referred to as PVA) and modified polyvinyl alcohol, epoxy group modified PVA, silanol group modified PVA, acrylamide modified PVA, butyral modified PVA-maleic acid copolymers, N-methylolurethane modified PVA, amino group modified PVA, and substantially perfectly saponified PVA are preferable. The substantially perfectly saponified PVA has preferably a saponification degree not less than about 98%. Among these polyvinyl alcohols, epoxy group modified PVA is particularly preferable.

Among the polymers having a plurality of carboxyl groups, styrene-acrylic acid copolymers, acrylic ester-acrylic acid copolymers, styrene-acryl ester-acrylic acid copolymers, styrene-maleic acid copolymers, isobutylene-maleic anhydride copolymers and their derivatives, and styrene-acrylic acid-acrylamide copolymers are preferable. Among these resins, isobutylene-maleic anhydride copolymers and their derivatives, and styrene-acrylamide copolymers are more preferable.

In addition, polyethylene imine, aqueous polyester resins, polyester resins, polyurethane resins, acrylate copolymers, epoxy resins, polyvinyl acetate resins, polyvinylidene chloride resins, polyvinyl chloride resins, and aqueous emulsions of derivatives of these resins can also be used.

The protective layer preferably includes a compound having a plurality of alkyleneimino groups as a crosslinking agent to obtain a protective layer having good resistance to water, resistance to blocking and good ability to be used with thermal printheads. Specific examples of such a compound having a plurality of alkyleneimino groups include compounds shown in Table 1.

TABLE 1

(1)

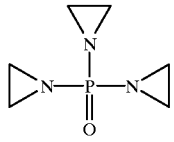

(2)

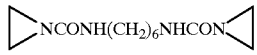

(3)

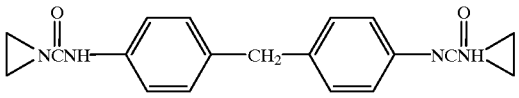

(4)

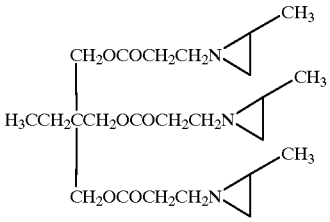

(5)

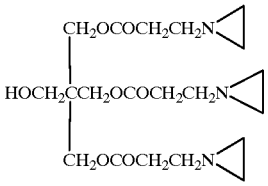

(6)

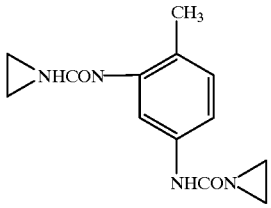

(7)

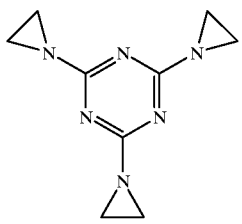

(8)

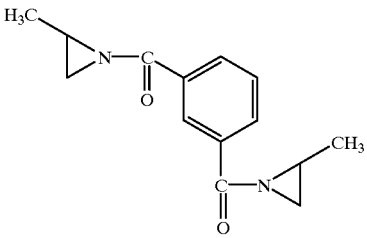

TABLE 1-continued (9)

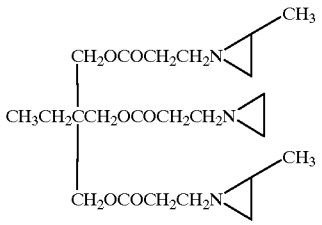

(10)

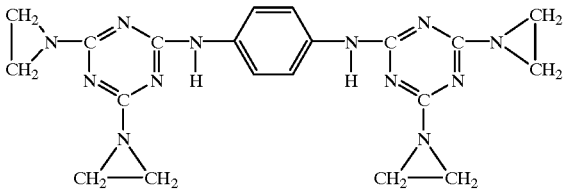

(11)

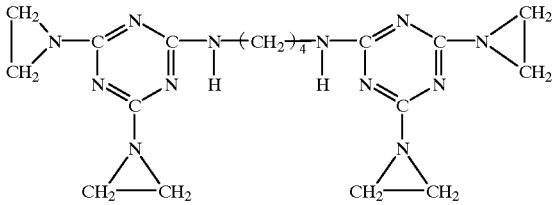

(12)

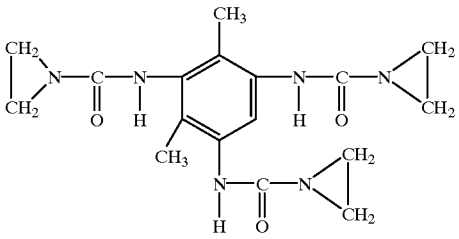

(13)

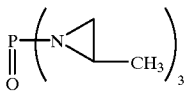

(14)

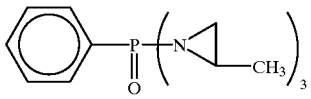

(15)

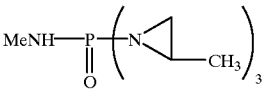

(16)

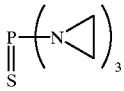

(17)

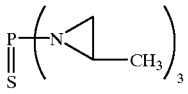

TABLE 1-continued (18)

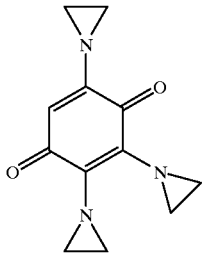

(19)

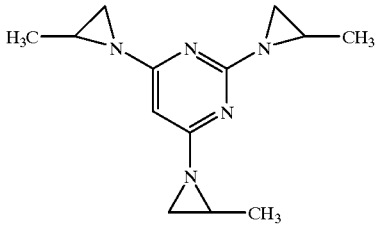

(20)

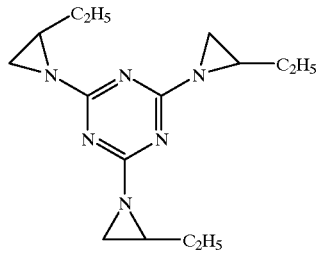

(21)

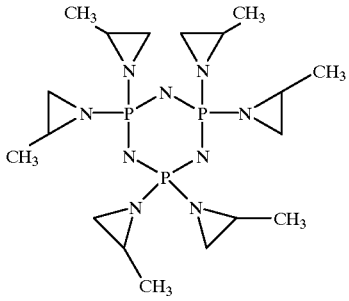

(22)

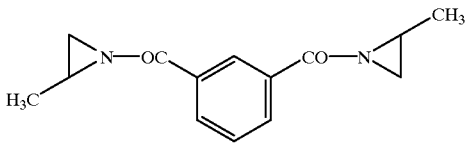

The compounds shown in Table 4 may be used together with a crosslinking agent such as glycidyl compounds, epichlorohydrin compounds, glyoxal, compounds having a methylol group, boric acid, and the like. By including such a crosslinking agent in the protective layer, resistance to water and resistance to blocking can be further improved.

The protective layer of the recording material of the present invention may further include auxiliary agents such as a filler, a surfactant, an ultraviolet light absorbing agent, a thermofusible material (or a lubricant), and an agent preventing the recording layer from coloring upon application of pressure.

Suitable fillers for use in the protective layer include inorganic fillers such as calcium carbonate, silica, zinc oxide, titanium oxide, aluminumoxide, zinc hydroxide, barium sulfate, clay, talc, calcium carbonate and silica which are subjected to surface treatment, and the like; and organic fillers such as particulate urea-formaldehyde resins, particulate styrene-methacrylic acid copolymers, particulate polystyrene resins, and the like.

Suitable thermofusible materials for use in the protective layer include thermofusible organic compounds such as higher fatty acids, esters and amides of higher fatty acids, metal salts of higher fatty acids (e.g., zinc stearate, calcium stearate, aluminum stearate and the like), waxes (polyethylene waxes, carnauba wax, paraffin waxes, microcrystalline waxes), condensation products of an aromatic carboxylic acid and an amine, fatty acid amides, phenyl benzoate, linear higher glycol, 3,4-epoxy-hexahydrophthalic acid dialkyl esters, higher ketones, p-benzyl biphenyl, and the like. These thermofusible materials preferably have a melting point of from about 50 to about 200° C.

The protective layer of the recording material of the present invention may be two or more layers, if desired.

Suitable color forming methods for use in the coloring layer of the recording material of the present invention include, but are not limited thereto:

(1) a method utilizing a coloring reaction of a coloring agent such as a leuco dye and a coloring developer;

(2) a method utilizing a coloring reaction of a diazo compound and a coupler; and (3) a method utilizing a coloring reaction of an isocyanate compound and an amine compound.

The method (1), which is the popular method in thermal recording, is hereinafter described.

Suitable leuco dyes for use in the coloring layer include known leuco dyes, which are used as a coloring agent in the coloring layers of conventional thermosensitive recording materials, such as triphenyl methane type leuco dyes, fluoran type leuco dyes, phenothiazine type leuco dyes, auramine type leuco dyes, spiropyran type leuco dyes, indolinophthalide type leuco dyes and the like.

Specific examples of such leuco dyes include:

3,3-bis(p-dimethylaminophenyl)phthalide, 3,3-bis(p-dimethylaminophenyl)-6-dimethylaminophthalide (i.e., Crystal Violet Lactone), 3,3-bis(p-dimethylaminophenyl)-6-diethylaminophthalide, 3,3-bis(p-diethylaminophenyl)-6-chlorophthalide, 3,3-bis(p-dibutylaminophenyl)phthalide, 3-N-methyl-N-isobutyl-6-methyl-7-anilinofluoran, 3-N-ethyl-N-isoamyl-6-methyl-7-anilinofluoran, 3-cyclohexylamino-6-chlorofluoran, 3-dimethylamino-5,7-dimethylfluoran, 3-diethylamino-7-chlorofluoran, 3-diethylamino-7-methylfluoran, 3-diethylamino-7,8-benzfluoran, 3-diethylamino-6-methyl-7-chlorofluoran, 3-(N-p-tolyl-N-ethylamino)-6-methyl-7-anilinofluoran, 3-pyrrolidino-6-methyl-7-anilinofluoran, 2-[N-(3'-trifluoromethylphenyl)amino]-6-diethylaminofluoran, 2-[3,6-bis(diethylamino)-9-(o-chloroanilino)xanthyl]-benzoic acid lactam, 3-diethylamino-6-methyl-7-(m-trichloromethylanilino)-fluoran, 3-diethylamino-7-(o-chloroanilino)fluoran, 3-di-n-butylamino-7-(o-chloroanilino)fluoran, 3-N-methyl-N-n-amylamino-6-methyl-7-anilinofluoran, 3-N-methyl-N-cyclohexylamino-6-methyl-7-anilinofluoran, 3-diethylamino-6-methyl-7-anilinofluoran, 3-diethylamino-6-methyl-7-(2',4'-dimethylanilino)fluoran, 3-(N,N-diethylamino)-5-methyl-7-(N,N-dibenzylamino)-fluoran, benzoyl leuco methylene blue, 6'-chloro-8'-methoxybenzoindolino-spiropyran, 6'-bromo-3'-methoxybenzoindolino-spiropyran, 3-(2'-hydroxy-4'-dimethylaminophenyl)-3-(2'-methoxy-5'-chlorophenyl)phthalide, 3-(2'-hydroxy-4'-dimethylaminophenyl)-3-(2'-methoxy-5'-nitrophenyl)phthalide, 3-(2'-hydroxy-4'-diethylaminophenyl)-3-(2'-methoxy-5'-methylphenyl)phthalide, 3-(2'-methoxy-4'-dimethylaminophenyl)-3-(2'-hydroxy-4'-chloro-5'-methylphenyl)phthalide, 3-morphorino-7-(N-propyl-trifluoromethylanilino)-fluoran, 3-pyrrolidino-7-trifluoromethylanilinofluoran, 3-diethylamino-5-chloro-7-(N-benzyl-trifluoromethylanilino)fluoran, 3-pyrrolidino-7-(di-p-chlorophenyl)methylaminofluoran, 3-diethylamino-5-chloro-7-(α-phenylethylamino)fluoran, 3-(N-ethyl-p-toluidino)-7-(α-phenylethylamino)fluoran, 3-diethylamino-7-(o-methoxycarbonylphenylamino)fluoran, 3-diethylamino-5-methyl-7-(α-phenylethylamino)fluoran, 3-diethylamino-7-piperidinofluoran, 2-chloro-3-(N-methyltoluidino)-7-(p-n-butylanilino)fluoran, 3-(N-methyl-N-isopropylamino)-6-methyl-7-anilinofluoran, 3-dibutylamino-6-methyl-7-anilinofluoran, 3,6-bis(dimethylamino)fluorenespiro(9,3')-6'-dimethylaminophthalide, 3-(N-benzyl-N-cyclohexylamino)-5,6-benzo-7-α-naphthylamino-4'-bromofluoran, 3-diethylamino-6-chloro-7-anilinofluoran, 3-N-ethyl-N-(2-ethoxypropyl)amino-6-methyl-7-anilinofluoran, 3-N-ethyl-N-tetrahydrofurfurylamino-6-methyl-7-anilinofluoran, 3-diethylamino-6-methyl-7-mesidino-4',5'-benzofluoran, 3-N-methyl-N-isobutyl-6-methyl-7-anilinofluoran, and the like.

These leuco dyes can be employed alone or in combination.

Suitable coloring developers for use in the coloring layer include known electron acceptors or oxidizing agents, which can react with the above-mentioned leuco dyes to induce color formation, such as phenolic compounds, thiophenolic compounds, thiourea derivatives, organic acids and their metal salts, and the like.

Specific examples of such color developers include:

4,4'-isopropylidenediphenol,
4,4'-isopropylidenebis(o-methylphenol),
4,4'-sec-butylidenebisphenol,
4,4'-isopropylidenebis(2-tert-butylphenol),
4,4'-cyclohexylidenebisdiphenol,
4,4'-isopropylidenebis(2-chlorophenol),
2,2'-methylenebis(4-methyl-6-tert-butylphenol),
2,2'-methylenebis(4-ethyl-6-tert-butylphenol),
4,4'-butylidenebis(6-tert-butyl-2-methyl)phenol,
1,1,3-tris(2-methyl-4-hydroxy-5-tert-butylphenyl) butane,
1,1,3-tris(2-methyl-4-hydroxy-5-cyclohexylphenyl) butane,
4,4'-thiobis(6-tert-butyl-2-methyl)phenol,
4,4'-diphenolsulfone,
4-isoproxy-4'-hydroxydiphenylsulfone,
4-benzyloxy-4'-hydroxydiphenylsulfone,
4,4'-diphenolsulfoxide,
isopropyl p-hydroxybenzoate,
benzyl p-hydroxybenzoate,
benzyl protocatechuate,
stearyl gallate,
lauryl gallate,
octyl gallate,
1,7-bis(4-hydroxyphenylthio)-3,5-dioxaheptane,
1,5-bis(4-hydroxyphenylthio)-3-oxapentane,
1,3-bis(4-hydroxyphenylthio)propane,
1,3-bis(4-hydroxyphenylthio)-2-hydroxypropane,
N,N'-diphenylthiourea,
N,N'-di(m-chlorophenyl)thiourea,
salicylanilide,
5-chloro-salicylanilide,
2-hydroxy-3-naphthoic acid,
1-hydroxy-2-naphthoic acid,
hydroxy naphthoic acid metal salts such as zinc, aluminum or calcium,
bis(4-hydroxyphenyl)acetic acid methyl ester,
bis(4-hydroxyphenyl)acetic acid benzyl ester,
1,3-bis(4-hydroxycumyl)benzene,
1,4-bis(4-hydroxycumyl)benzene,
2,4'-diphenolsulfone,
3,3'-diallyl-4,4'-diphenolsulfone,
α,α-bis(4-hydroxyphenyl)-α-methyltoluene,
antipyrine complex of zinc thiocyanate,
tetrabromobisphenol A,
tetrabromobisphenol S, and the like.

The coloring layer preferably includes a binder resin to securely fix the coloring agent and the coloring developer on a substrate.

Specific examples of such a binder resin include: water-soluble resins such as polyvinyl alcohol, carboxyl modified polyvinyl alcohol, starch and its derivatives, cellulose derivatives (e.g., hydroxymethyl cellulose, hydroxyethyl cellulose, carboxymethyl cellulose, methyl cellulose, ethyl cellulose, and the like), polyacrylic acid sodium salt, polyvinylpyrrolidone, acrylamide-acrylate copolymers, acrylamide-acrylate-methacrylic acid copolymers, alkali metal salts of styrene-maleic anhydride copolymers, alkali metal salts of ethylene-maleic anhydride copolymers, alkali metal salts of isobutylene-maleic anhydride copolymers, polyacrylamide, sodium alginate, casein, gelatin and the like; emulsions of resins such as polyvinyl acetate, polyurethane, polyacrylic acid, polyacrylate, vinyl chloride-vinyl acetate copolymers, polybutyl methacrylate, ethylene-vinyl acetate copolymers, styrene-butadiene copolymers, styrene-butadiene-acryl copolymers and the like. Among these resins, acetoacetyl modified PVA and highly crystallized polyvinyl alcohol, which are the same as the resin for use as a protective colloid in the core-shell type resin emulsion, are preferable to obtain good adhesion between the protective layer and the recording layer, and thereby high speed printing is possible when printing is needed on the recording material.

The coloring layer may further include auxiliary agents such as a filler, a surfactant, a thermofusible material (or a lubricant), an agent preventing the coloring layer from color forming upon application of pressure, and the like. These auxiliary agents include the materials described above for use in the protective layer.

The recording material of the present invention may include an under-coat layer between the substrate and the coloring layer to prevent migration of water or various chemicals to the coloring layer. The under-coat layer preferably includes one or more of the resins and one or more of the crosslinking agents both of which are described above for use in the protective layer. By forming such an under-coat layer, the recording material has the resistance to water and chemicals which penetrate through the back side of the substrate.

The recording material of the present invention may include a back-coat layer to obtain good resistance to water and chemicals. The back-coat layer preferably includes one or more of the resins and one or more of the crosslinking agents for use in the protective layer or the under-coat layer.

In addition, the recording material of the present invention may include a print layer, a magnetic recording layer, an adhesive layer, a releasing layer and the like.

The recording material of the present invention can be used for various purposes. For example, the recording material can be used as thermosensitive recording labels having an adhesive layer and optionally a print layer, or as thermosensitive recording tickets having a magnetic layer and optionally a print layer.

The thermosensitive recording labels preferably include a substrate, a coloring layer which is formed on one side of the substrate and which includes a leuco dye and a coloring developer mentioned above, a protective layer formed on the coloring layer, and an adhesive layer which is formed on the other side of the substrate and which is optionally covered with a liner. For example, when a release layer is formed on the protective layer, or the adhesive layer is a thermosensitive adhesive layer which is initially non-adhesive at room temperature (say, 25° C. or less) and becomes adhesive when ativated by heat, the liner is not needed. The adhesive layer an be adhered to various receiving materials, upon application of pressure or after being activated by heat. The recording labels may include a print layer overlying the coloring layer.

The thermosensitive recording tickets are almost the same as the thermosensitive recording labels mentioned above except that the adhesive layer is replaced with a magnetic recording layer which includes a ferromagnetic substance and a binder resin. The recording labels may also include a print layer overlying the coloring layer.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

(Formation of coloring layer)

The following ingredients were mixed and pulverized with a sand mill for two to four hours to prepare Liquids A.

| (Formulation of Liquid A) | |
|---|---|
| 3-(N-methyl-N-cyclohexyl)amino-6-methyl-7-anilinofluoran | 10 |
| 1% aqueous solution of a surfactant | 10 |
| water | 80 |

The following ingredients were mixed and pulverized with sand mill for two to four hours to prepare Liquids B.

| (Formulation of Liquid B) | |
|---|---|
| 4-hydroxyphenyl-4'-isopropoxyphenylsulfone | 30 |
| calcium carbonate | 30 |
| 1% aqueous solution of a surfactant | 30 |
| water | 10 |

Liquid A, Liquid B and the following Liquid C were mixed such that the mixing ratio was 1:1:3, to prepare a coloring layer coating liquid:

| (Formulation of Liquid C) | |
|---|---|
| Aqueous solution of acetoacetyl PVA (solid content of 10%) | 300 |

The coloring layer coating liquid was coated on a paper substrate and then dried to form a coloring layer having a coating weight of about 5 g/m$^2$ on a dry basis.

(Formation of protective layer)

The following components were mixed and pulverized with a sand mill for two to four hours to prepare a Liquid D.

| (Formation of Liquid D) | |
|---|---|
| kaolin | 10 |
| 1% aqueous solution of a surfactant | 10 |
| water | 80 |

Liquid D was mixed with the following Liquids E and F such that the mixing ratio was 1:1:1, to prepare a protective layer coating liquid.

| (Formation of Liquid E) | |
|---|---|
| Core-shell type aqueous resin emulsion of the present invention | 100 |

(one of trial products (EX series) manufactured by Mitsui Chemicals, Inc., solid content of 10%, protective colloid of acetoacetyl PVA)

| (Formation of Liquid F) | |
|---|---|
| 10% aqueous solution of a crosslinking agent (compound No. 5 shown in TABLE 2) | 10 |
| Water | 90 |

The protective layer coating liquid was coated on the recording layer and then dried to form a protective layer having a coating weight of 3 g/m$^2$ on a dry basis.

The thus prepared paper with a coloring layer and a protective layer was then subjected to calender treatment to smooth the surface of the protective layer.

Thus a thermosensitive recording material of the present invention was prepared.

Example 2

The procedure for preparation of the thermosensitive recording material in Example 1 was repeated to prepare a thermosensitive recording material of the present invention except that the addition quantity of Liquid C was changed to 200 (mixing ratio of Liquids A, B and C was 1:1:2).

Example 3

The procedure for preparation of the thermosensitive recording material in Example 1 was repeated to prepare a thermosensitive recording material of the present invention except that the addition quantity of Liquid C was changed to 100 (mixing ratio of Liquids A, B and C was 1:1:1).

Example 4

The procedure for preparation of the thermosensitive recording material in Example 1 was repeated to prepare a thermosensitive recording material of the present invention except that Liquid C was replaced with the following liquid:

| | |
|---|---|
| Aqueous solution of highly crystallized PVA (solid content of 10%) | 300 |

Example 5

The procedure for preparation of the thermosensitive recording material in Example 4 was repeated to prepare a thermosensitive recording material of the present invention except that Liquid E was replaced with the following liquid:

| | |
|---|---|
| Core-shell type aqueous resin emulsion of the present invention | 100 |

(one of trial products (EX series) manufactured by Mitsui Chemicals, Inc., solid content of 10%, protective colloid of highly crystallized PVA)

Example 6

The procedure for preparation of the thermosensitive recording material in Example 5 was repeated to prepare a thermosensitive recording material of the present invention except that Liquid C was replaced with the following liquid:

| | |
|---|---|
| Aqueous solution of carboxyl modified PVA (solid content of 10%) | 300 |

Example 7

The procedure for preparation of the thermosensitive recording material in Example 1 was repeated to prepare a thermosensitive recording material of the present invention except that the crosslinking agent in Liquid F was replaced with an epichlorohydrin type crosslinking agent and Liquid E was replaced with the following liquid:

| | |
|---|---|
| Core-shell type aqueous resin emulsion of the present invention | 100 |

(one of trial products (EX series) manufactured by Mitsui Chemicals, Inc., solid content of 10%, protective colloid of highly crystallized PVA)

Example 8

The procedure for preparation of the thermosensitive recording material in Example 7 was repeated to prepare a thermosensitive recording material of the present invention except that the crosslinking agent in Liquid F was replaced with a glyoxal type crosslinking agent.

Example 9

The procedure for preparation of the thermosensitive recording material in Example 1 was repeated to prepare a thermosensitive recording material of the present invention except that a back-coat layer of 3 g/m$^2$ on a dry basis was formed on the non-layered side of the substrate (i.e., the side opposite that bearing the coloring layer) by coating with the protective layer coating liquid prepared in Example 1 and drying the coated liquid.

Comparative Example 1

The procedure for preparation of the thermosensitive recording material in Example 1 was repeated (to prepare a comparative thermosensitive recording material) except that Liquid E was replaced with the following liquid:

| | |
|---|---|
| Core-shell type aqueous emulsion of a resin without a hydroxy group (solid content of 10%) | 100 |

Comparative Example 2

The procedure for preparation of the thermosensitive recording material in Example 7 was repeated (to prepare a comparative thermosensitive recording material) except that Liquid E was replaced with the following liquid:

| | |
|---|---|
| Aqueous solution of carboxyl modified PVA (solid content of 10%) | 100 |

Comparative Example 3

The procedure for preparation of the thermosensitive recording material in Comparative Example 1 was repeated (to prepare a comparative thermosensitive recording material) except that a back-coat layer of 3 g/m$^2$ on a dry basis was formed on the non-layered side of the substrate by coating with the protective layer coating liquid prepared in Comparative Example 1 and drying the coated liquid.

Comparative Example 4

The procedure for preparation of the thermosensitive recording material in Comparative Example 2 was repeated (to prepare a comparative thermosensitive recording material) except that a back-coat layer of 3 g/m$^2$ on a dry basis was formed on the non-layered side of the substrate by coating with the protective layer coating liquid prepared in Comparative Example 2 and drying the coated liquid.

The thus prepared thermosensitive recording materials of the present invention in Examples 1 to 9 and comparative thermosensitive recording materials in Comparative Examples 1 to 4 were evaluated with respect to the following items:

(1) Ability to be Used with Thermal Printhead

Each recording material was subjected to a continuous recording test of 10 m in length using a thermal printhead, and then the thermal printhead was visually observed to determine whether there was residue on the heating elements of the thermal printhead and the recorded images were also visually observed to determine whether the image qualities deteriorated.

Rank 5: Residue was hardly observed and image qualities did not deteriorate.

Rank 4: Residue was slightly observed but image qualities did not deteriorate.

Rank 3: Residue was observed but image qualities did not deteriorate.

Rank 2: Residue was observed and image qualities slightly deteriorated.

Rank 1: Residue was observed and image qualities seriously deteriorated.

(2) Resistance of Protective Layer to Plasticizer

A heated block at a temperature of 150° C. was brought into contact with the surface of each recording material to form a solid image (the image density thereof was from 1.35 to 1.38). The recorded image was overlaid with a wrapping film, Polywrap (brand name), and then allowed to set in a location at 40° C. for 24 hours to determine whether the image density deteriorated. The resistance to plasticizer was given as the image density after performance of the test.

(3) Resistance of Protective Layer to Water

Each recording material was dipped in water for 16 hours and then the protective layer was subjected to a rubbing test. The resistance to water was classified as follows:

Rank 5: the protective layer was not peeled after rubbing 10 times.

Rank 4: the protective layer was not peeled after rubbing 10 times but the surface thereof was slimy.

Rank 3: the protective layer was peeled after rubbing from 5 to 10 times.

Rank 2: the protective layer was peeled after rubbing from 1 to 4 times.

Rank 1: the protective layer was peeled before rubbing.

(4) Cracking Resistance of Protective Layer

Each recording material was drawn up and down through a trio of glass rods as shown in FIG. 1. In FIG. 1, the recording material 10 around the central glass rod 14 was drawn so that the protective layer contacted both the outer glass rods 11, 12. The test was performed with one trio of glass rods each 5 mm in diameter, and again with a second trio of glass rods each 10 mm in diameter. After the drawing, alcohol was coated on the protective layer to determine whether there was a crack in the protective layer. If the protective layer had a crack, the coloring layer colored because the alcohol penetrated into the coloring layer. The cracking resistance was evaluated as follows:

Rank 5: the coloring layer did not color when the diameter of the rods was 5 mm or 10 mm.

Rank 4: the coloring layer did not color when the diameter of the rods was 10 mm, but the coloring layer slightly colored when the diameter of the rods was 5 mm.

Rank 3: the coloring layer did not color when the diameter of the rods was 10 mm, but the coloring layer colored when the diameter of the rods was 5 mm.

Rank 2: the coloring layer slightly colored when the diameter of the rods was 10 mm, and the coloring layer colored when the diameter of the rods was 5 mm.

Rank 1: the coloring layer colored when the diameter of the rods was 5 mm or 10 mm.

(5) Resistance of Back-coat Layer to Plasticizer

The procedure for evaluation of the resistance of the protective layer to plasticizer was repeated except that the back-coat layer was overlaid with a wrapping film instead of the protective layer.

(6) Resistance of Back-coat Layer to Water

The procedure for evaluation of the resistance of the protective layer to water was repeated except that the back-coat layer was rubbed instead of the protective layer.

(7) Cracking Resistance of Back-coat Layer

The procedure for evaluation of the cracking resistance of the protective layer was repeated except that the recording material was drawn up and down such that the back-coat layer contacted both the outer glass rods.

The results are shown in Tables 2 and 3.

TABLE 2

| | Ability to be used with thermal printhead | Resistance of protective layer to plasticizer | Resistance of protective layer to water | Cracking resistance of protective layer |
|---|---|---|---|---|
| Example 1 | 5 | 1.34 | 5 | 5 |
| Example 2 | 4 | 1.25 | 4 | 4 |
| Example 3 | 4 | 1.29 | 4 | 3 |
| Example 4 | 4 | 1.32 | 4 | 5 |
| Example 5 | 5 | 1.36 | 5 | 5 |
| Example 6 | 3 | 1.30 | 3 | 3 |
| Example 7 | 4 | 1.25 | 3 | 3 |
| Example 8 | 4 | 1.29 | 3 | 3 |
| Comparative Example 1 | 2 | 1.24 | 5 | 1 |
| Comparative Example 2 | 2 | 1.23 | 1 | 5 |

TABLE 3

| | Resistance of back-coat layer to plasticizer | Resistance of back-coat layer to water | Cracking resistance of back-coat layer |
|---|---|---|---|
| Example 9 | 1.32 | 5 | 5 |
| Comparative Example 3 | 1.30 | 5 | 1 |
| Comparative Example 4 | 1.25 | 1 | 5 |

The results in Tables 2 and 3 clearly indicate that the thermosensitive recording materials of the present invention have good ability to be used with thermal printheads, good image qualities, good resistance to chemicals, and good cracking resistance.

Additional modifications and variations of the present invention are possible in light of the above teachings. It is therefore to be understood that within the scope of the appended claims the invention may be practiced other than as specifically described herein.

This application is based on Japanese Patent Application No. 09-233273, filed on Aug. 15, 1997, the entire contents of which are herein incorporated by reference.

What is claimed is:

1. A thermosensitive recording material comprising:

a substrate;

a thermosensitive coloring layer which is formed overlying one side of the substrate and which induces color formation upon application of heat; and a protective layer which is formed overlying the thermosensitive coloring layer and which comprises a resin, wherein the protective layer is formed by coating with a liquid including a core-shell type emulsion of the resin, and wherein the core-shell type emulsion of the resin is prepared by polymerizing monomers comprising (d) at least one of acrylamide and methacrylamide and (e) a vinyl monomer having a hydroxy group in the presence of a seed emulsion which is prepared by polymerizing monomers comprising (a) at least one of acrylamide and methacrylamide, (b) acrylonitrile and (c) a vinyl monomer having a hydroxy group.

2. The thermosensitive recording material according to claim 1, wherein the seed emulsion is prepared by polymerization in the presence of a protective colloid.

3. The thermosensitive recording material according to claim 2, wherein the protective colloid comprises at least one of acetoacetyl modified polyvinyl alcohol and highly crystallized polyvinyl alcohol.

4. The thermosensitive recording material according to claim 2, wherein the protective colloid is present in the core-shell emulsion in an amount of about 20% or more by weight on a dry basis.

5. The thermosensitive recording material according to claim 1, wherein the protective layer further comprises a compound having a plurality of alkyleneimino groups.

6. The thermosensitive recording material according to claim 1, wherein the thermosensitive coloring layer comprises a binder resin, and wherein the binder resin comprises at least one of acetoacetyl modified polyvinyl alcohol and highly crystallized polyvinyl alcohol.

7. The thermosensitive recording material according to claim 1, wherein the thermosensitive recording material further comprises a back-coat layer including a back-coat layer resin.

8. The thermosensitive recording material according to claim 7, wherein the back-coat layer is formed by coating with a liquid comprising a core-shell type emulsion of the back-coat layer resin, and wherein the core-shell type emulsion of the last-mentioned resin is prepared by polymerizing monomers comprising (d) at least one of acrylamide and methacrylamide and (e) a vinyl monomer having a hydroxy group in the presence of a seed emulsion which is prepared by polymerizing monomers comprising (a) at least one of acrylamide and methacrylamide, (b) acrylonitrile and (c) a vinyl monomer having a hydroxy group.

9. The thermosensitive recording material according to claim 1, wherein the thermosensitive recording material further comprises an adhesive layer which is formed overlying the other side of the substrate that bears the coloring layer and a print layer which is optionally formed overlying the coloring layer.

10. The thermosensitive recording material according to claim 9, wherein the thermosensitive recording material further comprises a liner which is overlaid on the adhesive layer.

11. The thermosensitive recording material according to claim 9, wherein the adhesive layer is thermosensitive which is initially non-adhesive at room temperature and becomes adhesive when activated by heat.

12. The thermosensitive recording material according to claim 9, wherein the thermosensitive recording material further comprises a release layer which is formed overlying the protective layer.

13. The thermosensitive recording material according to claim 1, wherein the thermosensitive recording material further comprises a magnetic recording layer which is formed overlying the other side of the substrate that bears the coloring layer and which comprises a ferromagnetic substance and a binder resin, and a print layer which is optionally formed overlying the coloring layer.

* * * * *